US005401120A

United States Patent [19]

Hussey et al.

[11] Patent Number: 5,401,120

[45] Date of Patent: Mar. 28, 1995

[54] PUMPABLE MINE SEAL

[76] Inventors: David A. Hussey, 2091 Haymaker Rd., Monroeville, Pa. 15146; William R. Semethy, Jr., 209 Forest Hills Rd., Pittsburgh, Pa. 15221-3711

[21] Appl. No.: 48,740

[22] Filed: Apr. 16, 1993

[51] Int. Cl.[6] ..... E04B 1/16; E21D 10/02

[52] U.S. Cl. ..... 405/132; 405/150.1; 52/242; 52/243; 264/35; 264/267

[58] Field of Search ..... 405/132, 150.1; 52/741.4, 742, 743; 299/12; 264/35, 267

[56] References Cited

U.S. PATENT DOCUMENTS

| | | | |
|---|---|---|---|
| Re. 32,675 | 5/1988 | Kennedy et al. | 405/132 |
| Re. 32,871 | 2/1989 | Kennedy et al. | 405/132 |
| Re. 34,053 | 9/1992 | Kennedy et al. | 405/132 |
| Re. 34,220 | 4/1993 | Kennedy et al. | 405/132 |
| 1,478,303 | 12/1923 | Synder | 405/132 X |
| 3,302,343 | 2/1967 | Bear | 52/98 |
| 4,023,372 | 5/1977 | Presler et al. | 61/45 R |
| 4,036,024 | 7/1977 | Dreker et al. | 61/42 |
| 4,483,642 | 11/1984 | Kennedy et al. | 405/132 |
| 4,516,879 | 5/1985 | Berry et al. | 405/132 |
| 4,547,094 | 10/1985 | Kennedy et al. | 405/132 |
| 5,167,474 | 12/1992 | Kennedy et al. | 405/132 |

*Primary Examiner*—Carl D. Friedman
*Assistant Examiner*—Robert J. Canfield
*Attorney, Agent, or Firm*—Buchanan Ingersoll; Michael L. Dever

[57] ABSTRACT

A pumpable mine assembly is provided having a pair of steel support structures forming the front and back surface of the seal. The support structures can be formed by either a row of vertically-disposed steel beams or a cable lattice secured by anchor bolts to the top and bottom surface of the mine entry. A separate wire mesh backing is provided on the inside of each of the pair of support structures. A seal bag placed within the wire mesh backing receives filling material, generally in the form of concrete. The filled seal bag forms a tight seal on the top, bottom and ribs of a mine entry or passageway.

13 Claims, 5 Drawing Sheets

PUMPABLE MINE SEAL

BACKGROUND OF THE INVENTION

1. Field of the Invention

The present invention relates to the field of ventilation seals for mining applications and, more particularly, to the field of pumpable permanent ventilation seals.

2. Description of the Prior Art

Mine seals are used to close off the main entry into a mine and passageways therein. Current Mine Safety and Health Administration (MSHA) guidelines require that the mine seals are sufficiently strong to withstand a 400 psi (1.38 MPa) instantaneous blast pressure and a 20 psi (69 kPa) static load. The prior art mine seals which were not designed for such blast criteria were formed from masonry, timber or concrete. Lateral resistance to movement of such a mine seal was provided by hitching the seal into the surrounding entry. There is a need for an improved mine seal capable of withstanding instantaneous blast criteria which can be assembled in a quick manner.

SUMMARY OF THE INVENTION

A pumpable mine seal is provided having a pair of spaced apart metal support structures formed from a row of vertically-disposed metal beams or a lattice structure formed of metal cable. The support structure is firmly anchored into the top and bottom of the mine entry or passageway by means of anchor bolts. A wire mesh backing is provided on the inner side of each of the pair of support structures. A seal bag is placed within the wire mesh and filling material such as a cementitious blend is pumped therein.

In a first preferred embodiment of the mine seal, a first and second pair of generally parallel spaced apart metal angles are secured to the roof and floor of said mine entry. A plurality of vertically-disposed metal beams are secured to the first pair of metal angles. The metal beams and metal angles form a support structure having an inby surface adjacent a side wall of the mine entry and an outby surface provided opposite thereof. A first wire mesh screen is provided on the outby surface of the support structure. A porous seal bag is positioned adjacent the wire mesh screen on the outby side thereof. A second wire mesh screen is provided adjacent the container seal bag on the outby side thereof. The wire mesh screens provide the frame work for the porous bag as the bag is filled with concrete. A plurality of vertically-disposed metal beams are secured to the second pair of metal angles on the outby side of the second wire mesh. Once the mine assembly is constructed, the seal bag can be filled with cementitious material to complete the seal.

Alternatively, in constructing the pumpable mine seal, front and back rows of bore holes are drilled into the top and bottom surface of the mine entry or passageway. Anchor bolts are secured in the bore holes and hanger plates are fastened thereto. Metal cable is strung between the back row of hanger plates to form a lattice frame having a criss-crossing diamond-shaped pattern. A wire mesh is secured to the back row of hanger plates on the front side of the lattice frame. A seal bag is then positioned next to the wire mesh. A second wire mesh and lattice frame are secured to the front row of hanger plates to form a sandwich-type structure. Once all elements are secured, the seal bag is filled with cementitious material. The resulting mine seal has a robust design having full contact with the top, bottom, and ribs of the mine entry or passageway. In this manner, an effective pumpable mine seal is inexpensively and quickly installed.

DETAILED DESCRIPTION OF THE PREFERRED EMBODIMENTS

Figure 1:
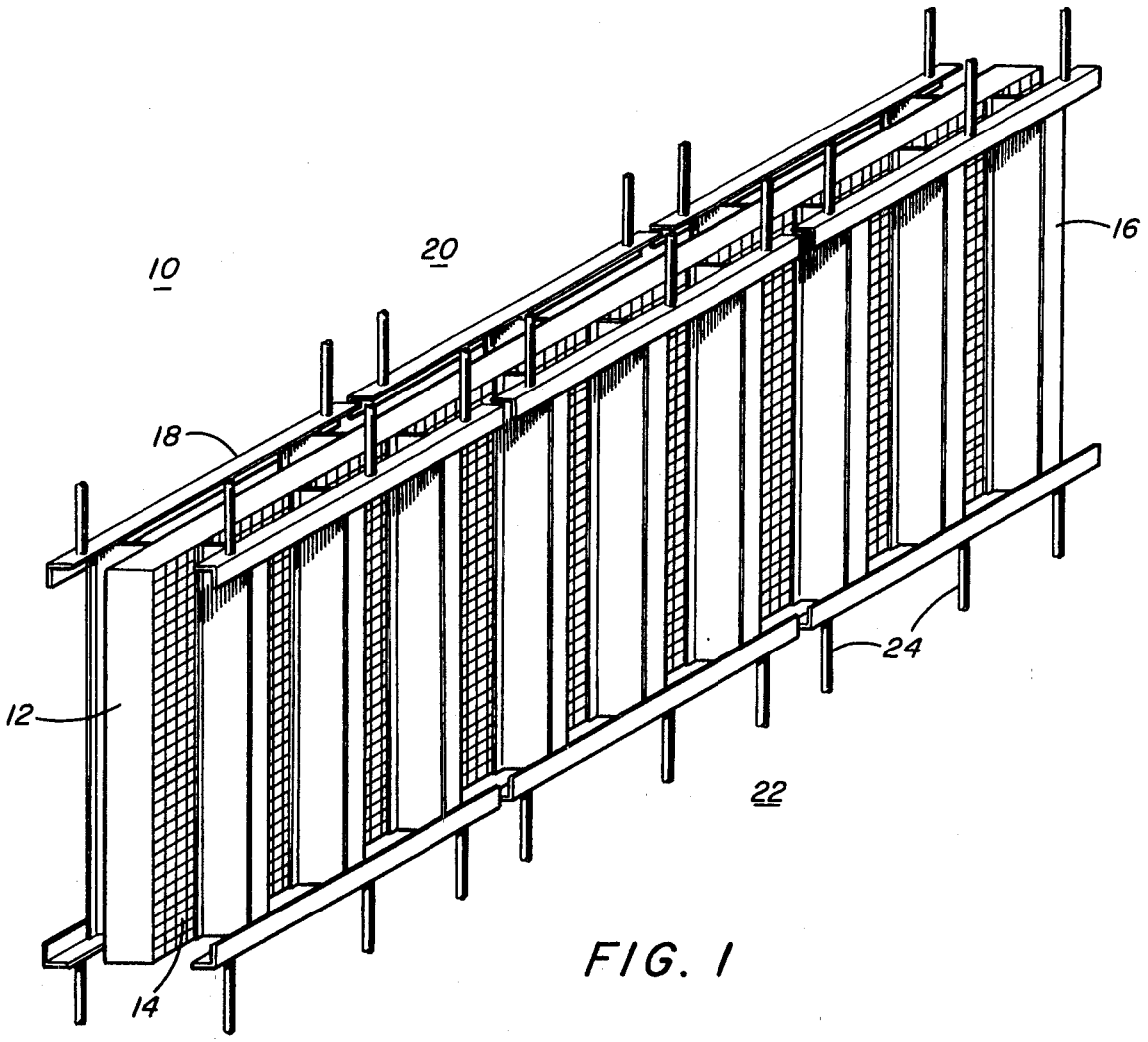
FIG. 1 is an isometric view of a first presently preferred embodiment of the pumpable mine seal in accordance with the present invention.
Figure 2:
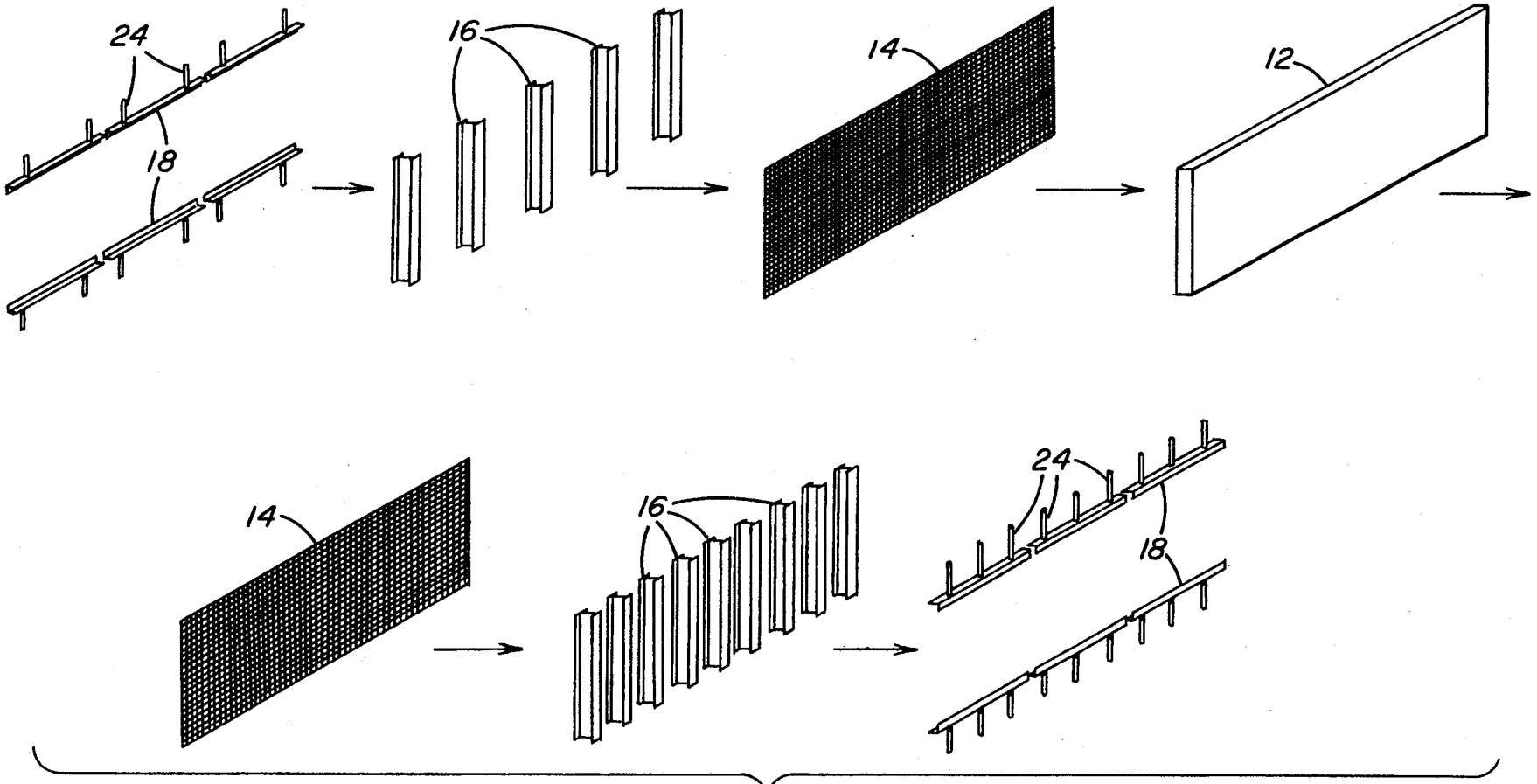
FIG. 2 is an exploded view of the pumpable mine seal of FIG. 1.
Figure 4:
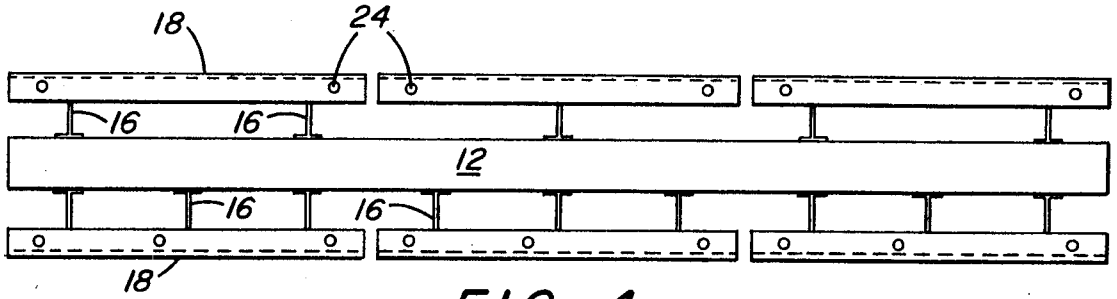
FIG. 4 is a plan view of the pumpable mine seal of FIG. 1.
Figure 3:
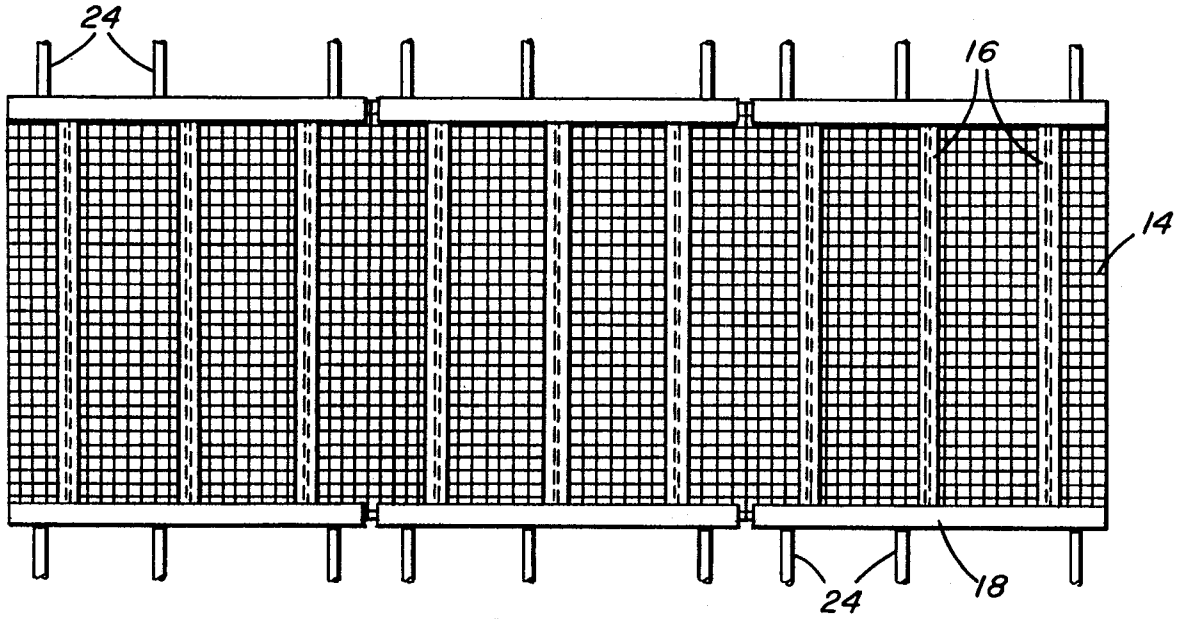
FIG. 3 is a front elevational view of the pumpable mine seal of FIG. 1.
Figure 5:
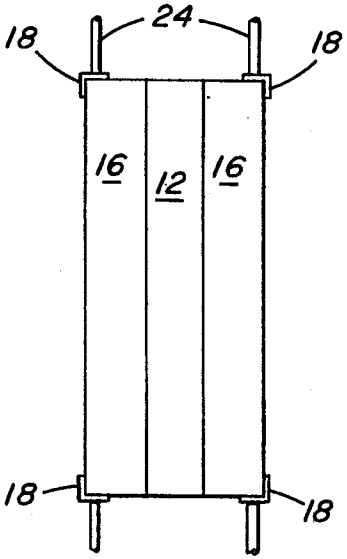
FIG. 5 is a side elevational view of the pumpable mine seal of FIG. 1.

A first presently preferred embodiment of the present pumpable mine seal is shown in isometric form in FIG. 1 and in exploded form in FIG. 2. FIGS. 3, 4, and 5 provide front elevational, plan and side elevational views of pumpable mine seal 10, respectively.

Pumpable mine seal 10 is a ventilation seal designed to withstand a 20.0 psi (138 kPa) static load. As shown in FIGS. 1 through 5, pumpable mine seal 10 includes a porous seal bag 12. Seal bag 12 is filled with cementitious material upon completion of the construction of pumpable mine seal assembly 10 to form a concrete slab that is at least one foot (0.3 m) thick. Wire mesh screen 14 is provided on both the outby and inby sides of seal bag 12 to serve as form work during the pumping of bag 12. Preferably wire mesh screen 14 is formed of a standard 3-inch steel wire mesh. Alternatively, screen 14 may be formed from other materials such as plastic.

The wire mesh screen 14 and seal bag 12 assembly of pumpable seal 10 is sandwiched within a steel support structure provided on both the outby and inby sides of the assembly. The steel support structure is formed by a row of steel beams 16 secured to steel angles 18 which are mounted to the roof 20 and floor 22 of the mine entry. Preferably, the steel angles 18 are bolted to the mine roof 20 and mine floor 22 using fully grouted roof bolts 24. Steel beams 16 are preferably of I-beam type and are secured to steel angles 18 by means of standard high strength bolts. The steel support structure acts as form work during the pumping process of seal bag 12 and then remains in place to act along with the concrete slab formed within seal bag 12 to provide added resistance to the required static load. Alternatively, the beams 16 may be formed from other metallic materials such as aluminum or from reinforced plastic or from fiber-reinforced carbon graphite.

Pumpable mine seal 10 is formed by assembling the steel support structure on the inby side of the seal. Separate steel angles 18 are bolted to the roof 20 and floor 22 of the mine entry using fully grouted roof bolts. Steel beams 16 are then bolted to the steel angles 18 using standard high strength bolts. Wire mesh 14 is then placed against the beams 16 and porous seal bag 12 is positioned adjacent the wire mesh 14. The outby support structure is constructed similar to the inby structure except in reverse order. After the outby beams 16 are in place, the inby and outby support structures are bolted together through seal bag 12 using standard high-strength bolts.

Once the pumpable mine seal assembly 10 is fully assembled, concrete is pumped into the porous seal bag 12 until the seal bag 12 is in full contact with the roof 20, floor 22 and the steel support structure. As seal bag 12 fills, excess water is forced out of the pores provided in bag 12. By forcing the water out of the concrete mix, the compressive strength of the concrete is enhanced and shrinkage of the concrete is eliminated. Pumpable mine seal 10 provides the same strength and reliability of a prior art masonry Mitchell Seal, but can be assembled by four men in a single work shift whereas ten man-shifts are required to assemble the Mitchell Seal.

Preferably, a cement blend such as HM-4 is used as the filling material. HM-4 has a high compressive strength of approximately 1500 psi minimum. This is over seven times the strength of foamed cement. Higher strength blends up to approximately 6000 psi can also be used. Pumpable mine seal 10 has been found to have a minimum mean compressive strength at 28 days of 2700 psi (18.62 MPa).

Figure 6:
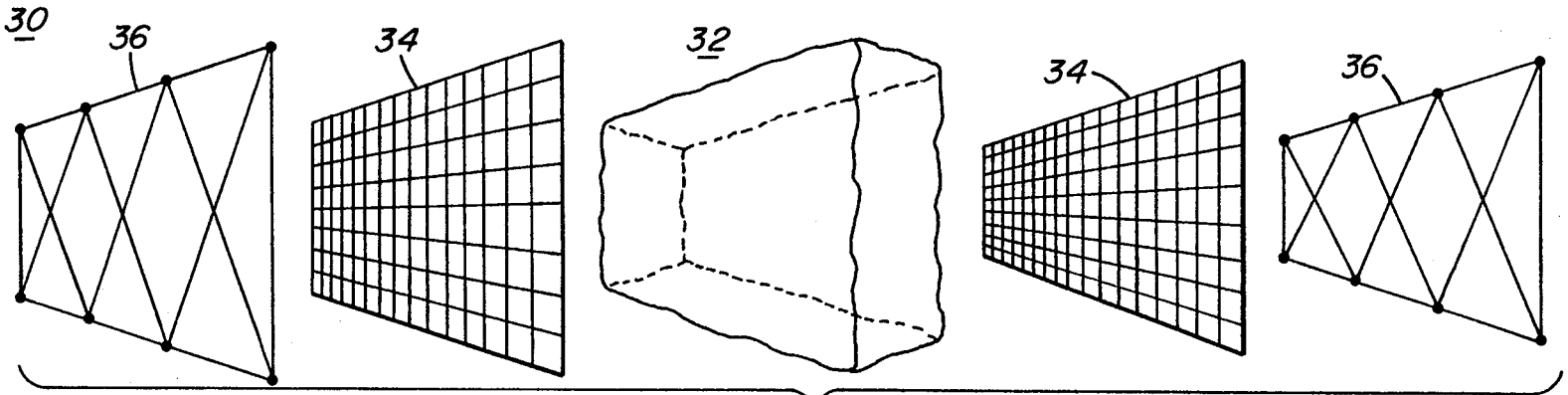
FIG. 6 is an exploded view of a second presently preferred embodiment of the pumpable mine seal in accordance with the present invention.
Figure 7:
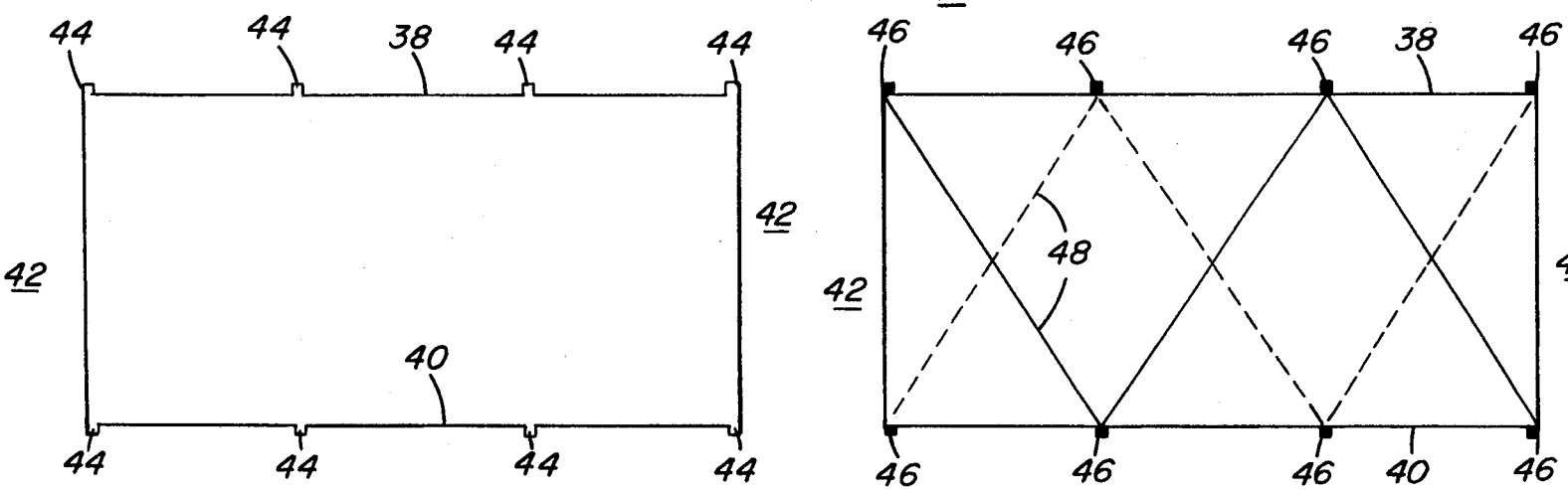
FIG. 7 is a front view of a mine entry showing the first step in a preferred method of installing the pumpable mine seal of FIG. 6.

A second presently preferred embodiment of the present pumpable mine seal is shown in exploded form in FIG. 6. As shown in FIG. 6, pumpable mine seal 30 includes a seal bag 32 filled with cementitious material sandwiched between two wire mesh screens 34 which are, in turn, sandwiched between two cable lattice frames 36. Preferably, wire mesh screen 34 is formed of a standard steel mesh and lattice frame 36 is formed from two pairs of criss-crossing 0,5 inch diameter steel cable.

The method of forming pumpable mine seal 30 is shown in FIGS. 7 through 10. Beginning in FIG. 7, a mine entry or passageway is shown having a top 38, bottom 40, and side ribs 42. Side ribs 42 schematically shown in FIGS. 7–10 can be any of the well known rib structures previously used in the mining industry. Anchor holes 44 are provided along the top 38 and bottom 40 of the mine entry in a spaced apart relationship. The anchor holes 44 are provided by boring holes into the top 38, bottom 40, and ribs 42 of a mine entry or passageway which has previously been cleaned by dislodging and removing all loose material therefrom. After the holes 44 are provided in the mine entry, anchor bolts are installed therein. The anchor bolts are embedded into the top 38 and bottom 40 of the mine entry or passageway a sufficient length to achieve a firm anchorage with hanger plates 46 attached into each hole. Hanger plates 46 schematically shown in FIGS. 8–10 can be any of the well known hanger plate structures previously used in the mining industry.

Figure 8:
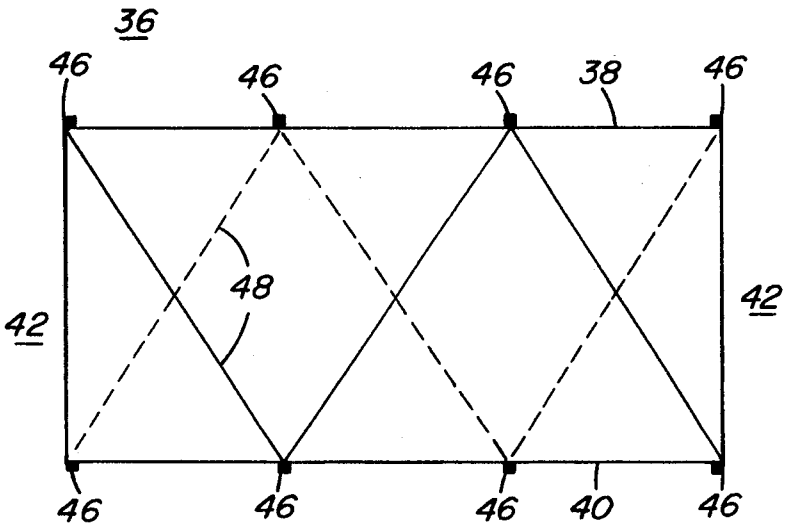
FIG. 8 is a front view of a mine entry showing the second step in a preferred method of installing the pumpable mine seal of FIG. 6.

As shown in FIG. 8, once the hanger plates 46 are attached to an anchor bolt in each bore, a pair of 0.5 inch diameter steel cables 48 are threaded through alternating top and bottom hanger plates 46 to form the lattice frame 36. The pair of cables 48 form a criss-crossing pattern to form a generally diamond-shaped lattice frame 36. Each steel cable 48 should be pulled taut and securely fastened to the hanger plates. The lattice frame 36 thus formed will serve as the back of the pumpable mine seal 30 opposite the pumping side.

Figure 9:
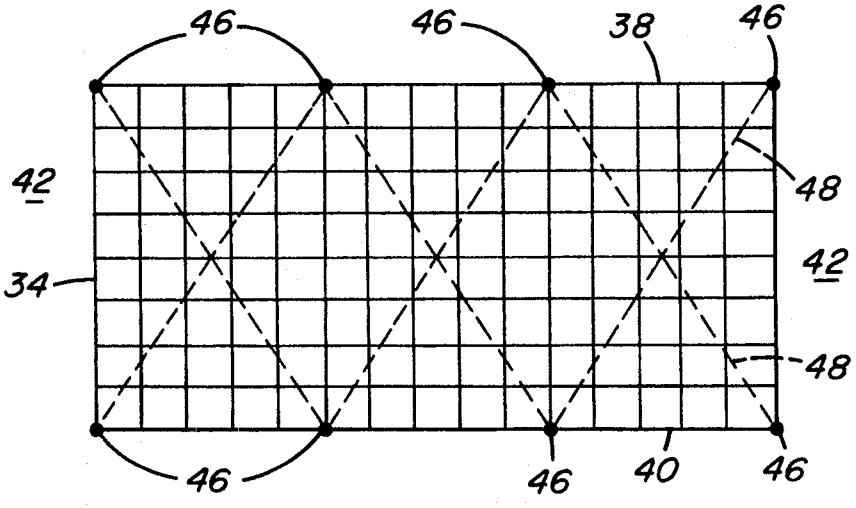
FIG. 9 is a front view of a mine entry showing the third step in a preferred method of installing the pumpable mine seal of FIG. 6.

As shown in FIG. 9, once lattice frame 36 is installed, wire mesh 34 is positioned thereagainst. The wire mesh 34 is provided along on pumping side of the already-installed lattice frame 36. Tie wire is used to secure wire mesh 34 to the hanger plates 46.

Figure 10:
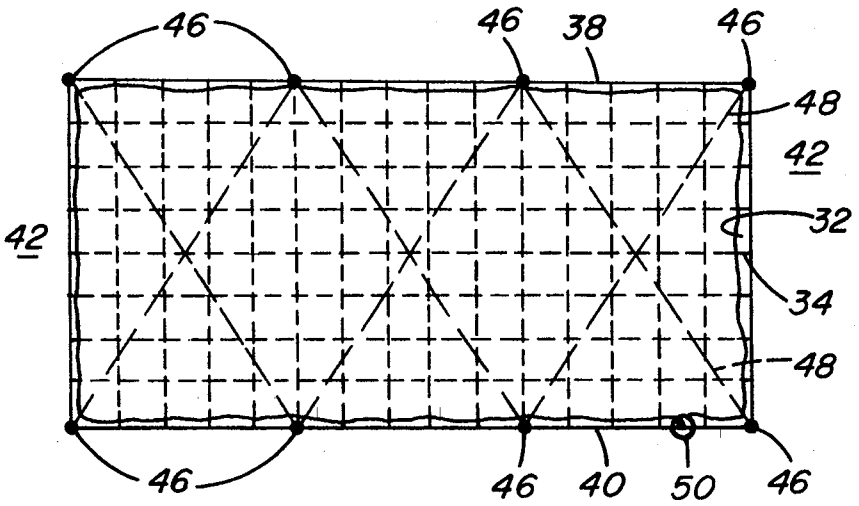
FIG. 10 is a front view of a mine entry showing the fourth step in a preferred method of installing the pumpable mine seal of FIG. 6.

As shown in FIG. 10, the next step in forming the pumpable mine seal 30 is to position seal bag 32 adjacent wire mesh 34. Tie wire is used to fasten seal bag to the hanger plates 46. Once seal bag 32 is situated, air sampling tubes 50 are provided as specified by the mine. Air sampling tubes 50 schematically shown in FIG. 10 can be any of the well known air tube structures previously used in the mining industry.

Once the seal bag 32 is positioned, the wire mesh 34 and lattice frame 36 on the pumping side of the seal are installed. The pumping side lattice 36 and wire mesh 34 are installed in the same manner as the opposing side lattice frame 36 and wire mesh 34, except wire mesh 34 is installed first followed by cable lattice frame 36. In this manner, the pumpable mine seal as shown in FIG. 6 is formed.

Once the pumpable mine seal 30 is assembled in the manner described above, seal bag 32 is ready to be filled with the filling material. As with the pumpable mine seal of FIG. 1, a cement blend such as HM-4 is used as the filling material.

The procedure for filling the seal bag 12 or 32 is initiated by placing a pump in a convenient location to the construction area. The cementitious material can be pumped for distances over 3000 feet. The pump is connected to the pumping hose which is in turn connected to seal bag 12 or 32. Pumping is begun by setting the material feed rate and water flow rate of the pump to achieve the water-to-solids ratio recommended for the cementitious material. Pumping of the cementitious material is continued after the seal bag fills, thus forcing any excess water from the seal bag 32. This continued pumping also insures that seal bag 12 is tight against the roof 20, floor 22 and steel structure of the mine seal 10 and that seal bag 32 is tight against the top 38, bottom 40, and ribs 42 of the mine entry. Pumping is stopped once cementitious material in addition to water begins to ooze through the pores of seal bag 32.

Pumpable mine seal 30 easily makes and maintains full contact with the mine roof 38, bottom 40, and ribs 42. The wire cables 48 anchored by roof bolts and hanger plates 46 add tremendous strength to the completed seal. Although the installed cost of the pumpable mine seal 30 of the present invention is nearly the same as a Mitchell Seal, the pumpable mine seal of the present invention can be fully installed in less than one shift compared to five shifts necessary for the Mitchell seal. Pumpable mine seal 30 has been found to have a minimum mean compressive strength at 28 days of 1500 psi (10.34 MPa).

In the foregoing specification certain preferred practices and embodiments of this invention have been set out, however, it will be understood the invention may be otherwise embodied within the scope of the following claims.

We claim:

1. A pumpable mine seal comprising:

a. a pair of generally parallel spaced apart support structures provided in one of a mine entry and passageway, said support structures being anchored to opposing surfaces of said one of a mine entry and passageway;

b. screen means provided adjacent to each of said pair of support structures within the space between said pair of support structures;

c. container means placed within the space between said screen means; and d. filling material provided in said container means.

2. The pumpable mine seal of claim 1 wherein said filling material is cementitious material having a minimum compressive strength of 1500 psi.

3. The pumpable mine seal of claim 2 further comprising air sampling tubes provided through said pumpable mine seal, generally transverse to each of said pair of spaced apart support structures.

4. The pumpable mine seal of claim 1 wherein said support structures are cable lattice frames.

5. The pumpable mine seal of claim 4 further comprising two rows of a plurality of spaced apart anchor bolts provided on the top and bottom surface of said one of a mine entry and passageway, each of said two rows corresponding to one of said pair of spaced apart cable lattice frames.

6. The pumpable mine seal of claim 5 wherein each said cable lattice frame comprises a pair of steel cables, each of said pair of steel cables secured to alternating top and bottom surface anchor bolts.

7. The pumpable mine seal of claim 6 wherein each of said pair of steel cables has a diameter of approximately 0.5 inch.

8. The pumpable mine seal of claim 6 wherein said screen means and said container means are secured to said plurality of anchor bolts.

9. The pumpable mine seal of claim 1 wherein each of said support structures comprises a plurality of vertically-disposed beams secured to a top surface and a bottom surface of said one of a mine entry and passageway.

10. A method for forming a pumpable mine seal in a mine entry comprising the steps of:

a. providing a front and back set of spaced apart top and bottom rows of anchor bores provided in the surface of said mine entry, said rows provided generally transverse to said mine entry;

b. installing anchor bolts in each of said anchor bores;

c. attaching hanger plates to each said anchor bolt to form a front and back set of spaced apart top and bottom rows of hanger plates;

d. securing a pair of steel cables to alternating top and bottom hanger plates on said back set of hanger plates to form a first diamond shaped lattice frame;

e. providing a first wire mesh screen on the front side of said first lattice frame;

f. positioning container means adjacent said wire mesh screen on the front side thereof;

g. providing a second wire mesh screen adjacent said container means on the front side thereof;

h. forming a second cable lattice frame on said front set of hanger plates; and i. filling said container means with cementitious material.

11. The method of claim 10 wherein said first wire mesh screen and said second wire mesh screen are secured to said first set of hanger plates and said second set of hanger plates, respectively.

12. The method of claim 11 wherein said container means is filled with cementitious material until said cementitious material begins to ooze from said container means.

13. A method for forming a pumpable mine seal in a mine entry comprising the steps of:

a. securing a first and second pair of generally parallel spaced apart angles to the roof and floor of said mine entry;

b. securing a plurality of vertically-disposed beams to said first pair of angles, said beams and angles forming a support structure, said support structure having an inby surface adjacent a side wall of said mine entry and an outby surface provided opposite said inby surface;

c. providing a first screen on said outby surface of said support structure;

d. positioning container means adjacent said screen on the outby side thereof;

e. providing a second screen adjacent said container means on the outby side thereof;

f. securing a plurality of vertically-disposed beams to said second pair of angles on the outby side of said second screen; and g. filling said container means with cementitious material.

* * * * *